US005390918A

United States Patent [19]

Meyers et al.

[11] Patent Number: 5,390,918

[45] Date of Patent: Feb. 21, 1995

[54] ADJUSTABLE GOLF PUTTER HEAD

[76] Inventors: Frederick C. Meyers, 7 W. Ayres St., Hinsdale, Ill. 60521; Charles H. Travis, 212 Middaugh, Clarendon Hills, Ill. 60514

[21] Appl. No.: 239,452

[22] Filed: May 9, 1994

[51] Int. Cl.[6] ..... A63B 53/02

[52] U.S. Cl. ..... 273/79; 273/80.1; 273/80 C; 273/167 G

[58] Field of Search ..... 273/167 R–167 G, 273/77 R, 80.1, 80.2, 80 C, 79, 168, 80 R, 193 R, 194 R; 403/362, 90, 76; 15/176.1, 176.6

[56] References Cited

U.S. PATENT DOCUMENTS

| | | | |
|---|---|---|---|
| 749,174 | 1/1904 | Davis | 273/79 |
| 1,182,209 | 5/1916 | Rolfe | 273/79 |
| 1,313,504 | 8/1919 | Rolfe | 273/79 |
| 1,352,020 | 9/1920 | Olson | 273/79 |
| 2,027,452 | 1/1936 | Rushing | 273/79 |
| 2,477,438 | 7/1949 | Brouwer | 273/79 |
| 2,495,444 | 1/1950 | Chamberlain et al. | 273/79 |
| 2,571,970 | 10/1951 | Verderber | 116/133 |
| 2,708,579 | 5/1955 | Hugman | 273/79 |
| 2,777,694 | 1/1957 | Winter | 273/79 |
| 2,882,053 | 4/1959 | Lorthiois | 273/79 |
| 3,096,982 | 7/1963 | Bassin | 273/80.1 |
| 3,214,170 | 10/1965 | Warnock | 273/80.1 |
| 4,073,492 | 2/1978 | Taylor | 273/80.2 |
| 4,736,951 | 4/1988 | Grant | 273/79 |
| 4,881,737 | 11/1989 | Mullins | 273/80 |
| 4,884,808 | 12/1989 | Retzer | 273/77 A |
| 5,116,047 | 5/1992 | Phelan | 273/80.1 |
| 5,244,205 | 9/1993 | Melanson | 273/80.1 X |
| 5,320,346 | 6/1994 | Phillips | 273/80 C |

*Primary Examiner*—Sebastiano Passaniti

*Attorney, Agent, or Firm*—Pravel, Hewitt, Kimball & Krieger

[57] ABSTRACT

An adjustable golf putter includes an elongated shaft having an upper end with a handle and a lower end with a spherical tip portion. A putter head has an external surface and a socket that includes an enlarged open end portion for receiving the enlarged tip of the shaft, the socket also having a restricted opening through which the shaft passes, but which will not allow passage of the spherical head. A plurality of set screw openings extend between the socket and the external surface of the putter head. A plurality of set screws extend respectively through the plurality of set screw openings each having a pointed tip that engages the enlarged spherical end of the shaft. The enlarged spherical end of the shaft can be of softer metal material than the material for the set screws.

23 Claims, 2 Drawing Sheets

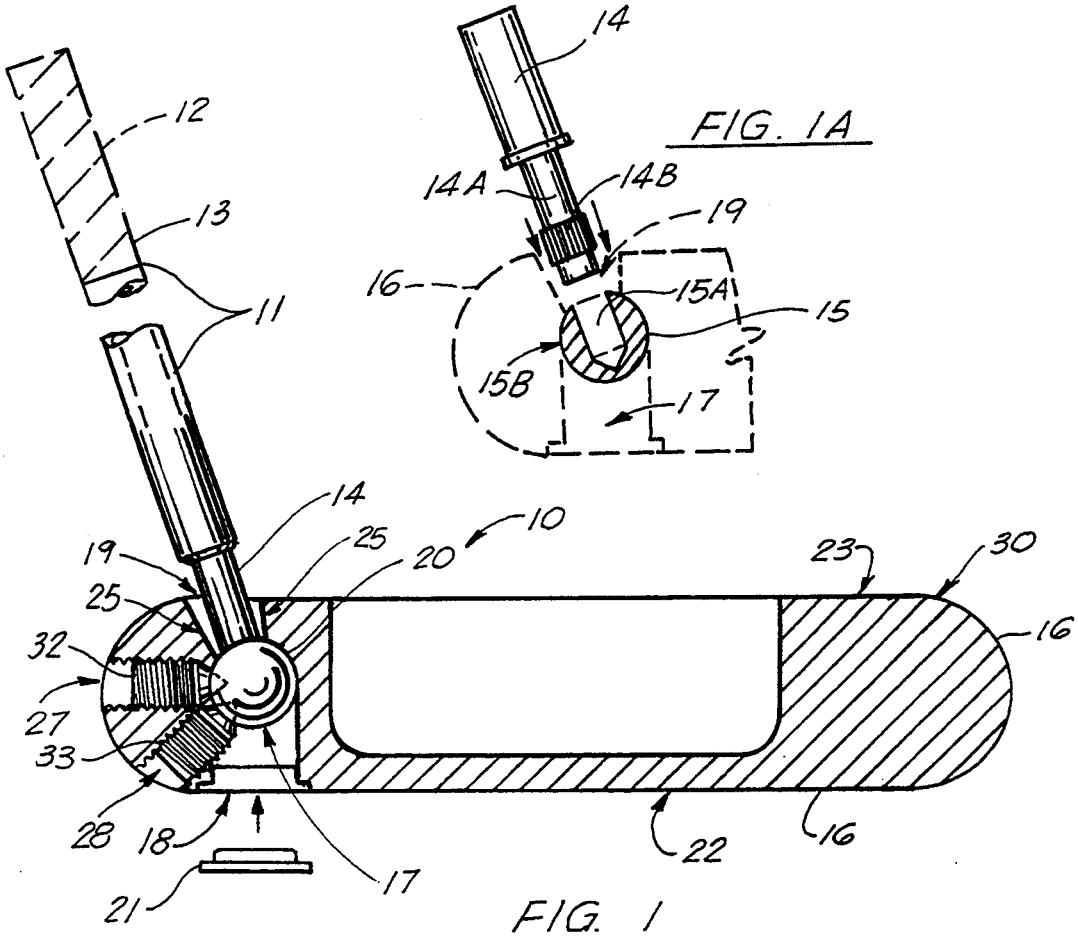
FIG. 1A
FIG. 1
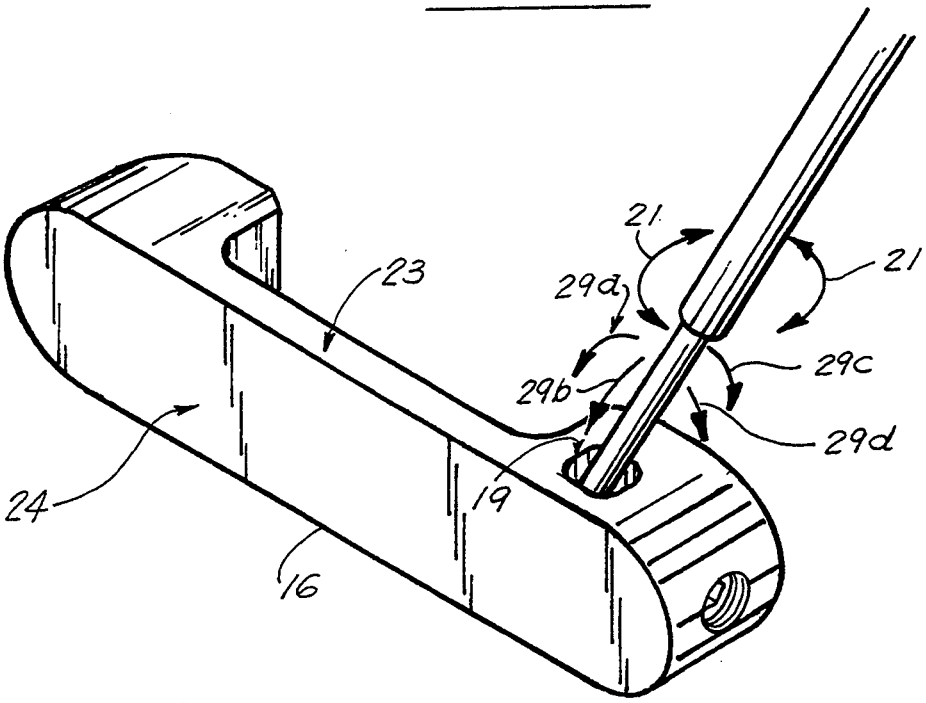
FIG. 2

ADJUSTABLE GOLF PUTTER HEAD

BACKGROUND OF THE INVENTION

1. Field of the Invention

The present invention relates to golf clubs and more particularly to an adjustable golf putter for adjusting both loft and lie. More particularly the present invention relates to an adjustable putter head that includes a one piece integral putter head having a socket that receives a socket connector (preferably a ball) mounted at the distal end of the putter shaft, and wherein multiple set screws carried in the putter head and angularly oriented with respect to each other can be tightened to rigidity the putter head with respect to the shaft. The ball is preferably of a softer metal than the set screws to insure that a rigid connection is made between each set screw and the ball once a selected position of the putter head is selected relative to the shaft.

2. General Background

One of the most critical aspects of the game of golf involves putting and the putter selected by the user. The golfer must have a putter that matches his or her stroke, often a function of the particular body structure of the individual. Further, the putter selected by the user could change depending on the current green surface confronting the player.

Therefore, there is a need for a putter that one could adjust depending on ones stroke or current green surface. The concept of an adjustable putter per se is not a new concept. Many patents have issued that related to golf clubs that have a head that is adjustable relative to the shaft.

Early patents that disclose putters having adjustable head relative to the shaft include the Davis U.S. Pat. No. 749,174 entitled "Putter"; the Rolfe U.S. Pat. No. 1,182,209 entitled "Golf Club" and the Olson U.S. Pat. No. 1,352,020 entitled "Golf Club". Another early adjustable golf club in seen is U.S. Pat. No. 1,313,504 issued to C. A. Rolfe entitled "Golf Club". In these early patents, a pivotal connection is disclosed between the head of the club and the shaft. In some patents and a ball and socket type connection between the head of the club and the shaft in other patent.

Later patents include U.S. Pat. No. 3,214,170 issued to Warnock entitled "Adjustable Golf Club". The Warnock patent shows a pivoting connection between the club shaft and the putter head that features a pair of spaced apart set screws at affix positions of the shaft relative to the head in one plane by using a generally semi-circular disk like member attached to the shaft which rides in a similarly shaped recess of the club head. A ball and socket clamp head putter allows three hundred sixty degree (360°) rotatability between the end of the shaft and the club head.

The Hugman U.S. Pat. No. 2,708,579 entitled "Ball and Socket Clamp Head Putter" uses a two part club head that fits about a ball tip end portion of the club shaft. The two halves of the putter heads are secured together with machine screws and tightened so as to clamp the putter head in a desired position upon the ball tip end portion of the club. The putter head provides a substantially flat front face, a substantially flat top face, a substantially flat bottom face and ends, with a ball position within the head, occupying a concave socket portion of each of the halves of the putter head. The two concave recess portions of the putter head are aligned to fit against the ball or spherical tip end of the club shaft upon assembly. The '579 patent claims to provide a universal joint to facilitate the adjustment of the head at a desired angle, and wherein the ball portion of the universal joint extends below the bottom face of the head to hold the head above the surface of a putting green when the putter is swung for contact with a golf ball.

A more recent adjustable putter is seen in U.S. Pat. No. 4,881,737 entitled "True Roll Putter". The '737 patent provides an elongated generally cylindrically head with an up standing handle shaft inclined between sixteen degrees (16°) and twenty two degrees (22°) relative to a vertical plane normal to the longitudinal center line of the head. The shaft is connected to the head for adjustment of the incline of the shaft relative to the shaft and the lower extremities of the opposite ends of the head are disposed in a horizontal plane spaced below the lower extremity of the longitudinal mid portion of the head. The opposite ends of the head each include alternating large and small diameter zones spaced longitudinally of the head which function to rapidly diminish the amplitude of vibrations of the head, traveling both transversely and longitudinally thereof, resulting from impact of either side of the head with a golf ball.

One example of a conventional club that is adjusted to suit the player's particular style and stance and then permanently locked in that position is disclosed in U.S. Pat. No. 4,073,492. Other examples of adjustable clubs are disclosed in U.S. Pat. Nos. 3,096,982; 4,736,951; 2,447,438; 2,495,444; 2,777,694; 2,571,970 and 2,882,053. Each of the clubs disclosed in the listed patents suffers from one or more of the problems discussed above.

The present invention provides an improved adjustable golf putter that includes a rugged integrally formed putter head with a shaft that adjustably attaches thereto by means of a spherically shaped end portion of the lower tip of the putter shaft.

The present invention provides adjustability that accommodates the physical preferences of golfers including tall, short, fat, thin, etc. players as well as the mental preferences, including players that like very upright putter lies to those players that prefer a flatter plane.

The present invention provides an improved adjustable golf putter that adapts the putter to golf greens in various climates. For example, some golf greens are very fast while other golf greens are very slow. Further, cooler parts of the world normally have bent grass greens whereas Bermuda grass is typically used in warmer parts of the world. Each of these different grass conditions might well require a different loft angle of the face of the club to get the ball to roll properly.

SUMMARY OF THE INVENTION

The present invention provides a putter that contains a mechanism for connecting the club shaft to the club head and affording adjustability yet ruggedness. The head design can be a "toe and heel weighted" milled block such as brass. This design is preferred and symmetrical so that it can easily adapt to left handed golfers.

The present invention provides an improved adjustable putter that allows a user to adjust the loft or lie depending upon ones stroke or current green surface.

In the preferred embodiment, the present invention provides an adjustable golf putter that includes a elongated shaft having an upper end portion with a gripping surface and a lower end portion that includes an enlarged spherical tip.

The putter head has an external surface and a socket for receiving the enlarged tip portion of the shaft. The socket provides an open end sized and shaped to receive the spherical tip portion and a restricted opening end portion that allows the shaft but not the spherical tip to pass therethrough.

A plurality of set screw openings extend between the socket and the external of the putter head. A plurality of set screws extend respectively through the plurality of set screw openings, each having a pointed end to engage the enlarged tip of the shaft wherein one of the set screws can be positioned to prevent removal of the spherical tip from the socket and wherein the enlarged tip portion is of a material that is softer than the material for the set screws.

Another object of the invention is to provide an adjustable club that complies with competition regulations.

Another object of the invention is to provide an adjustable golf club head that can be mounted on conventional golf club shafts.

In summary, there is provided an adjustable golf club simple design and construction that can be continuously adjusted by the user to customize the club to the user's preferred stance and address of the ball. The golf club comprises a shaft having a ball at one end and a club head having a socket therein for receiving the ball and thereby forming a ball and socket moveable joint to mount the head to the shaft. The invention further comprises means for limiting the movement of the head relative to the shaft to comply with competitive golf association rules. The invention further comprises a means for selectively securing the movable joint so as to prevent movement thereof during the course of play.

The invention consists of certain novel features and a combination of parts hereinafter fully described, illustrated in the accompanying drawings and particular pointed out in the appended claims, it being understood that various changes in the details may be made without departing from the spirit or sacrificing any of the advantages of the present invention.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein:

FIG. 1 is a elevational view of a the putter head portion of the preferred embodiment of the apparatus of the present invention;

FIG. 1A is a fragmentary view of the preferred embodiment of the apparatus of the present invention;

FIG. 2 is a partial elevational view of the preferred embodiment of the apparatus of the present invention;

DETAILED DESCRIPTION OF THE PREFERRED EMBODIMENT

Figure 3:
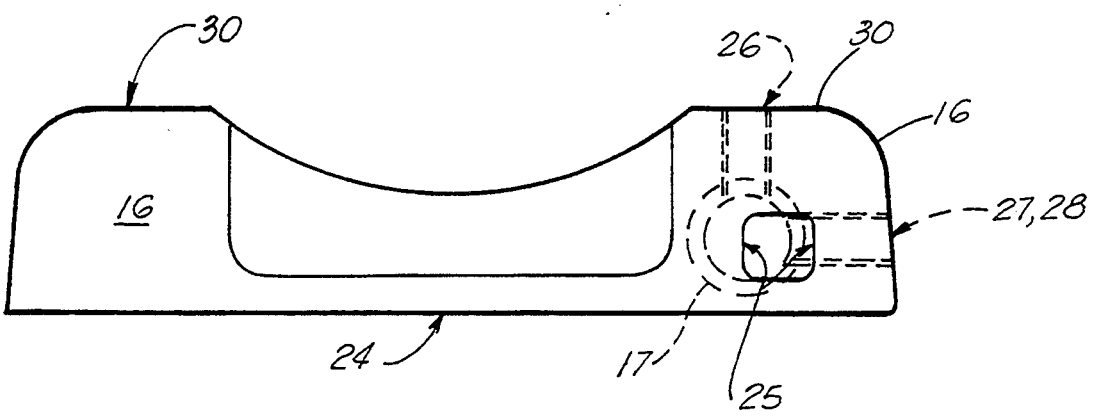
FIG. 3 is a partial top view of the preferred embodiment of the apparatus of the present invention illustrating the putter head.
Figure 4:
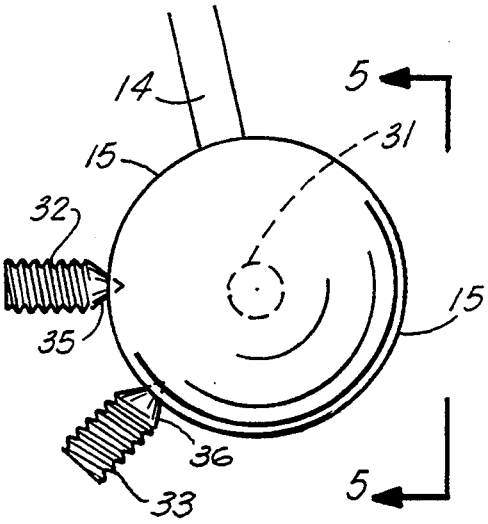
FIG. 4 is a fragmentary elevational view of the preferred embodiment of the apparatus of the present invention showing the lower end of the putter shaft.
Figure 5:
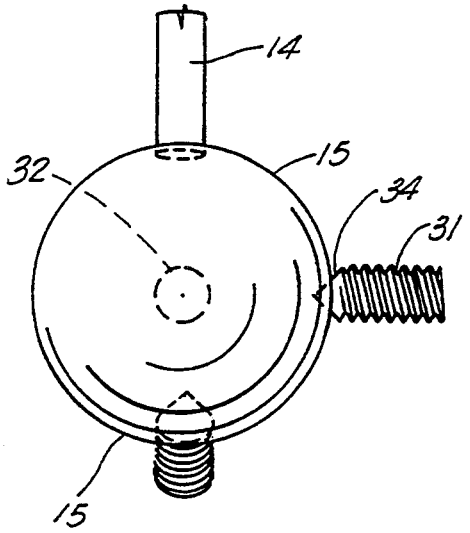
FIG. 5 is a sectional view taken along line 5—5 of FIG. 4.

FIGS. 1–5 illustrate the preferred embodiment of the apparatus of the present invention designated generally by the numeral 10. Adjustable golf putter 10 includes an elongated shaft 11 having a handle 12 at its upper or proximal end portion 13. The lower end portion 14 of shaft 11 carries a spherically shaped distal tip 15 that forms a ball and socket connection with club head 16 as will be described more fully hereinafter. Club head 16 can be for example, a "toe and heel weighted" brass block of integral construction such as for example, a block of milled brass.

Head 16 could also be a casting made in accordance with the configuration shown in the drawings. A socket 17 is occupied by the spherical tip 15 during use. Socket 17 has an enlarged lower open end 18 and a smaller restricted opening end 19. The end portion 19 allows shaft lower end 14 to extend therethrough as shown in FIGS. 1 and 2. However, the restricted opening end 19 is too large for spherical tip 15 to pass therethrough. Enlarged open end 18 is however large enough for spherical tip 15 to enter socket 17.

Upon assembly, spherical tip 15 is inserted into open end 18 to seat against hemispherical recess 20 portion of socket 17 (see FIG. 1). Plug 21 can be used to close opening 18.

Hosel 14A has a plurality of circumferentially spaced ribs that register into cylindrical opening 15A in spherical tip 15. The hosel 14A and its ribs 15B can be of stainless steel, and the spherical tip 15 of brass. Upon assembly, sphere 15 is inserted into socket 17 from the bottom 22 of putter head 16. Hosel 14A is inserted through restricted opening 19 at the top 23 of putter head 16 and press fitted into opening 15A. The hosel 14A can be welded for example to shaft 11. Putter head 16 can be sized and shaped as shown, having a generally flat bottom surface 22, a generally flat top surface 23, and a generally flat club face 24 that engages the golf ball during play.

In FIGS. 1, 2, and 3, restricted opening 19 is shown as including an inner wall 25 that extends between upper surface 23 and hemispherically shaped recess 20 of socket 17. Wall 25 can be sized and shaped to define degrees of movement of shaft 11 relative to club 16. In FIGS. 1–2 it can be seen that shaft 11 can rotate relative to head 16 (see arrows 21). The wall 25 defines a limit for pivotal movement of shaft 11 relative to putter head 16. Arrow **29*a* defines movement away from a user, 29*b* and 29*c* define movement that angles the club face 24 relative to the playing surface while arrow 29*d* shows pivoting of the shaft toward the user. Thus, wall 25 limits movement of shaft 11 relative to putter head 16** in each of these directions.

A plurality of threaded passageways 26–28 are provided, extending between an exterior surface 30 of putter head 16 and socket 17. Each passageway 26–28 provides internal threads for receiving the threads of an allen screw 31–33. Each allen screw 31–33 provides a respective pointed, conically shaped tip 34–36 for engaging the spherical tip 15 during use.

In the preferred embodiment, spherical tip 15 is of a soft metal such as brass whereas the allen screws 31–33 are of a harder material such as stainless steal. This allows each allen screw 31–33 to bite into the surface 15B of spherical tip 15, forming a rigid connection therewith.

Because the allen screws 31–33 bite into the spherically shaped tip 15, a very rigid connection is formed between the shaft and putter head. By using the pointed tips of the allen screws in combination with brass or softer metal spherical tip 15, very minor adjustments in position of the club head 16 relative to shaft 11 can be made if desired by the user. The lie angle is adjustable from fifty (50) degrees to eighty (80) degrees from horizontal while the loft angle is adjustable from a negative twelve (12) degrees to a positive twelve (12) degrees from vertical.

The following table lists the parts numbers and parts descriptions as used herein and in the drawings attached hereto.

PARTS LIST

| Part Number | Description |
|---|---|
| 10 | adjustable golf putter |
| 11 | shaft |
| 12 | handle |
| 13 | upper end |
| 14 | lower end |
| 14A | hosel |
| 14B | ribs |
| 15 | spherical tip |
| 15A | opening |
| 15B | surface |
| 16 | putter head |
| 17 | socket |
| 18 | larger opening |
| 19 | smaller opening |
| 20 | hemispherical recess |
| 21 | arrows |
| 22 | flat bottom surface |
| 23 | flat top surface |
| 24 | club face |
| 25 | wall |
| 26 | threaded passage |
| 27 | threaded passage |
| 28 | threaded passage |
| 29a | arrow |
| 29b | arrow |
| 29c | arrow |
| 29d | arrow |
| 30 | exterior surface |
| 31 | allen screw |
| 32 | allen screw |
| 33 | allen screw |
| 34 | conical tip |
| 35 | conical tip |
| 36 | conical tip |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An adjustable golf putter comprising:

a) an elongated shaft having an upper end portion with a gripping surface and a lower end portion that includes an enlarged spherical tip portion;

b) a putter head having an external surface and a socket for receiving the enlarged tip portion of the shaft;

c) a plurality of openings extending between the socket and the external surface;

d) a plurality of set screws extending through the openings, each having a pointed end to engage the enlarged tip portion of the shaft; and e) wherein the enlarged tip portion is of a material that is softer than the set screws.

2. The apparatus of claim 1 wherein the spherical tip portion is of a brass material.

3. The apparatus of claim 1 wherein two of the set screws form an acute angle relative to one another.

4. The apparatus of claim 1 wherein the spherical tip portion is integrally connected to the shaft.

5. The apparatus of claim 1 wherein there are three openings and three set screws.

6. The apparatus of claim 5 wherein two of the set screws form an acute angle relative to one another.

7. The apparatus of claim 5 wherein two of the set screws form an obtuse angle.

8. The apparatus of claim 5 wherein two of the set screws form an acute angle relative to one another.

9. The apparatus of claim 5 wherein two of the set screws form an obtuse angle relative to one another.

10. The apparatus of claim 1 wherein two of the set screws form an obtuse angle relative to one another.

11. The apparatus of claim 1 wherein the spherical tip portion is of a material that is softer than the set screws.

12. The apparatus of claim 1 wherein at least two of the set screws form an acute angle relative to one another.

13. The apparatus of claim 1 wherein the spherical tip portion is integrally connected to the shaft.

14. The apparatus of claim 1 wherein there are three openings and three corresponding set screws.

15. The apparatus of claim 1 wherein two of the set screws form an obtuse angle relative to one another.

16. The apparatus of claim 1 wherein the socket has a hemispherically shaped portion and a cylindrically shaped portion.

17. The adjustable golf club according to claim 1 wherein the loft angle of said head is adjustable.

18. The adjustable golf club according to claim 17 wherein the adjustment of the loft angle is limited.

19. The adjustable golf club according to claim 18 wherein the lie angle is adjustable from fifty (50) degrees to eighty (80) degrees from horizontal.

20. The adjustable golf club according to claim 18 wherein the loft angle is adjustable from a negative twelve (12) degrees to a positive twelve (12) degrees from vertical.

21. The adjustable golf club according to claim 1 wherein the lie angle of said head is adjustable.

22. The adjustable golf club according to claim 21 wherein the adjustment of the lie angle is limited.

23. An adjustable golf putter comprising:

a) an elongated shaft having an upper end portion with a gripping surface and a lower end portion that includes an enlarged spherical tip portion with a center point that is removably attachable to said lower end portion;

b) a putter head having an external surface that includes upper and lower surface portions, each having respective upper and lower surface openings;

c) a socket for receiving the enlarged spherical tip portion of the shaft the socket having a lower end portion that communicates with the lower surface opening, the socket being sized and shaped to receive the spherical tip via the lower surface opening;

d) a plurality of openings extending between the socket and the external surface along lines that extend to the center point;

e) a plurality of set screws extending through the openings, each having a pointed end to engage the enlarged tip portion of the shaft; and f) wherein each of the set screws forms an angle with each of the other set screws.

* * * * *